US008104496B1

(12) United States Patent
Washington et al.

(10) Patent No.: US 8,104,496 B1
(45) Date of Patent: Jan. 31, 2012

(54) REVERSE FLOW BACK PRESSURE PUMP

(76) Inventors: Bryan Washington, Chicago, IL (US); Bernard Thompson, Chicago, IL (US)

( * ) Notice: Subject to any disclaimer, the term of this patent is extended or adjusted under 35 U.S.C. 154(b) by 377 days.

(21) Appl. No.: 12/421,415

(22) Filed: Apr. 9, 2009

Related U.S. Application Data

(60) Provisional application No. 61/123,984, filed on Apr. 11, 2008.

(51) Int. Cl.
*E03B 5/00* (2006.01)
*E03B 7/07* (2006.01)

(52) U.S. Cl. ..... 137/15.04; 137/239; 137/565.12; 137/565.25

(58) Field of Classification Search ..... 137/565.12, 137/565.25, 239, 557, 544, 1, 15.04
See application file for complete search history.

(56) References Cited

U.S. PATENT DOCUMENTS

| | | | | | |
|---|---|---|---|---|---|
| 357,717 | A | * | 2/1887 | Lawless | 137/565.25 |
| 2,918,878 | A | * | 12/1959 | Zieg et al. | 137/215 |
| 4,497,290 | A | * | 2/1985 | Harris | 137/565.25 |
| 4,953,581 | A | * | 9/1990 | Patterson | 137/239 |
| 5,433,246 | A | * | 7/1995 | Horton | 137/565.12 |

* cited by examiner

*Primary Examiner* — Kevin Lee
(74) *Attorney, Agent, or Firm* — The Eclipse Group LLP

(57) ABSTRACT

A reverse flow back pressure pump that enables liquid to flow in a reverse direction in plumbing fixtures in order to loosen and discharge sediment freed during the reverse flow.

11 Claims, 2 Drawing Sheets

REVERSE FLOW BACK PRESSURE PUMP

RELATED APPLICATIONS

This application claims priority to U.S. Provisional Patent Application Ser. No. 61/123,984, filed on Apr. 11, 2008, and titled "Reverse Flow Back Pressure Pump" under 35 U.S.C. §119(e), and is also herein incorporated by reference.

TECHNICAL FIELD

This invention generally relates to plumbing tools, and more specifically, relates to plumbing tools used to unclog plumbing fixtures.

BACKGROUND OF THE INVENTION

Currently, there are many old homes that have galvanized or other corrodible pipes that supply water to the numerous plumbing fixtures found in a home. As corrosion and other sediment build up within the pipes, water flow is adversely affected. In such situations, a plumber is typically called to temporarily fix the problem without replacing the pipes. Known approaches to temporarily fix the water flow problems in fixtures has been to turn off the water service to the home and disassemble one or more of the fixtures to physically insert a metal "snake" or other device to remove any blockages or otherwise open the pipe. This approach is time consuming for the plumber and costly for the home owner.

Thus, there is a need for an approach to clearing the water supply pipes without having to remove fixtures, while reducing the amount of time required for completing the maintenance on the pipes.

SUMMARY

An approach to clearing water supply fixture of sediment and other blockages without having to disassemble fixtures while saving time is described. The approach involves forcing water in the opposite direction through the fixture at a pressure sufficient to dislodge sediment and other materials that may be restricting water flow. A hand pump is connected to a faucet or other fixture and is filled with water. The pump then is used to force water back through the faucet to dislodge sediment, such as rust and calcium. The pump also may have a valve that will let the water flow through the pump and out to the drain or bucket. The dislodged sediment is able to flow through the valve resulting in a cleared fixture with pressure restored.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The components in the figures are not necessarily to scale, emphasis instead being placed upon illustrating the principles of the invention. In the figures, like reference numerals designate corresponding parts throughout the different views.

DETAILED DESCRIPTION

An approach for implementing a reverse flow back pressure water pump is described. The approach enables a user to quickly and efficiently remove sediment from fixtures due to rust, calcium buildup or similar blockages that restrict water flow.

Figure 1:
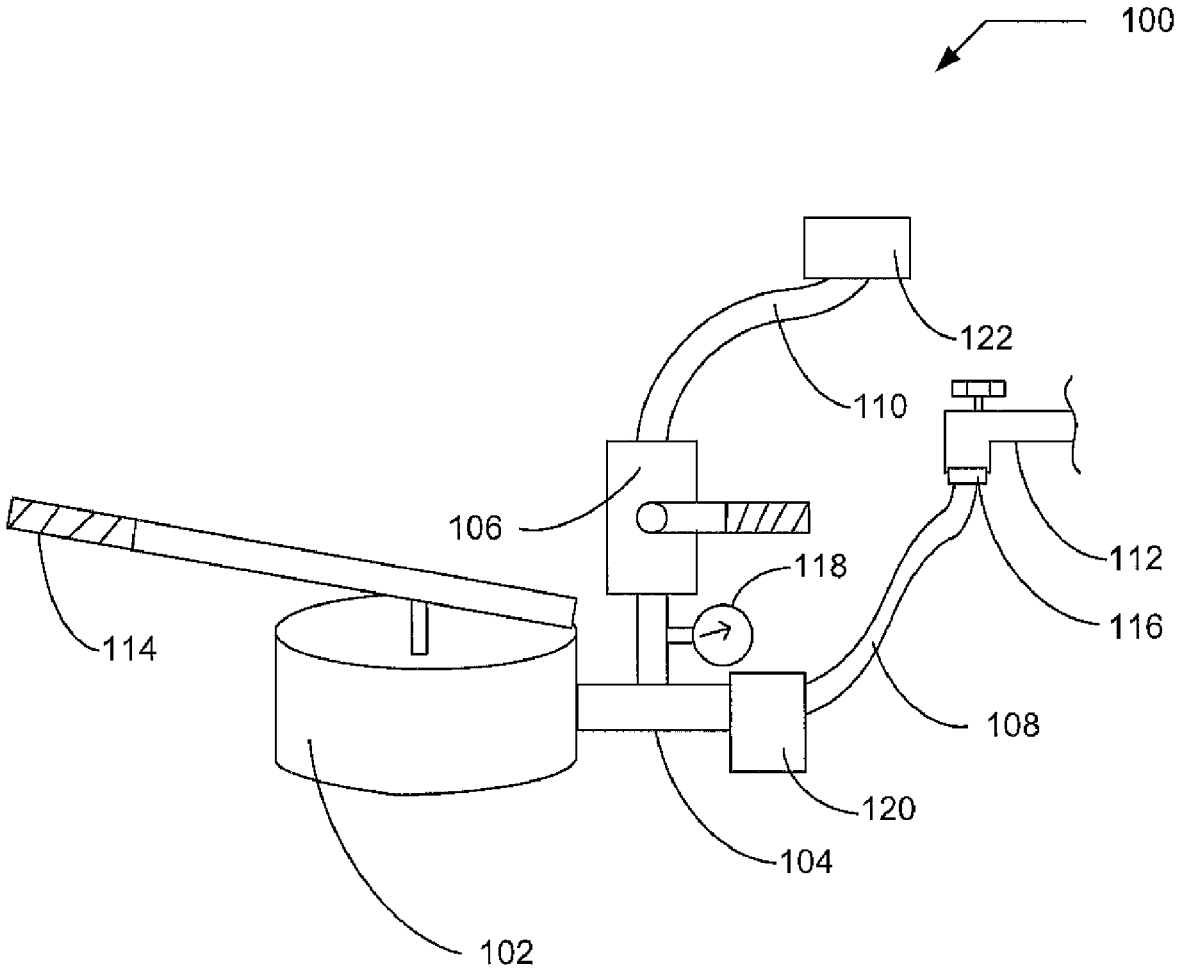
FIG. 1 is a diagram of a reverse flow back pressure pump in accordance with an implementation of the invention.

Turning to FIG. 1, a diagram 100 of a reverse flow back pressure pump in accordance with an implementation of the invention is shown. A pump 102, such as a hand powered diaphragm pump is connected to a tee coupler 104 that has an on/off valve 106 coupled to one opening of the tee 104 and a fill hose 108 coupled to the other opening 120 of the tee 104. The on/off valve 106 also is coupled to a discharge hose 110 that is adapted to fit on a plumbing fixture, such as a bathroom faucet.

The on/off valve 106 is placed in an open or first position and the faucet is turned on. The water from the faucet travels through the fill hose 108 and pump 102 fills with water or other liquid depending on what comes out of the faucet. Since the on/off valve 106 is open, the water will proceed to exit the pump 102 via the discharge hose 110. When the on/off valve 106 is placed in the second or closed position, the pump 102 fills with water until the pressure is equalized between the water pressure in the faucet 112 and the water pressure in the pump 102.

The pump 102 is activated or pumped to increase the water pressure in the fill hose 108 and force water back into the faucet 112. If the pump 102 is a diaphragm pump, then a handle 114 may be used to pump the pump 102 and increase the water pressure in fill hose 108. Water is forced back into the pipes within the house via faucet 112 in a direction opposite in which the sediment was formed in the fixture. The force of the water pressure going in generally an opposite direction aids in the loosening and freeing of sediment in the fixture. The use of a hand powered pump aids in limiting the pressure that is built up in the fill hose 108 and water pipes located within the home or other building.

To flush out the sediment that has been loosened, a user opens or places the on/off valve 106 in a first position. The sediment is then allowed to flow through the fill hose 108 from faucet 112 through valve 106 and exit through the discharge hose 110. The household water pressure provides the force to flush the sediments out of the faucet.

Additionally, one end of the fill hose 108 may have a fitting 116 that enables the fill hose to connect to the threads commonly found on a faucet when the faucet strainer (not shown) is removed. In other implementations, the fill hose 108 may have a generic or fitting that accepts other fittings with thread sizes commonly found in faucets. Another feature that may be found on the reverse flow back pressure pump is a pressure gauge 118 to more accurately know the amount of back pressure. The pressure gauge 118 may be located anywhere on the pump that is under pressure when the ball valve 106 is closed.

Other features that may be included in the reverse flow back pressure pump are strainers on either or both of the hoses (fill hose 108 and discharge hose 106). A strainer on the fill hose 108 would assure large pieces of sediment are not being forced into the plumbing fixture and trap sediment when the pressure is released. The sediment would be trapped before it enters the pump assuring the pump stays clean and operational. The strainer 122 on the discharge hose prevents the solid sediment from going into a drain or bucket and enables it to be disposed of as solid waste trash.

Figure 2:
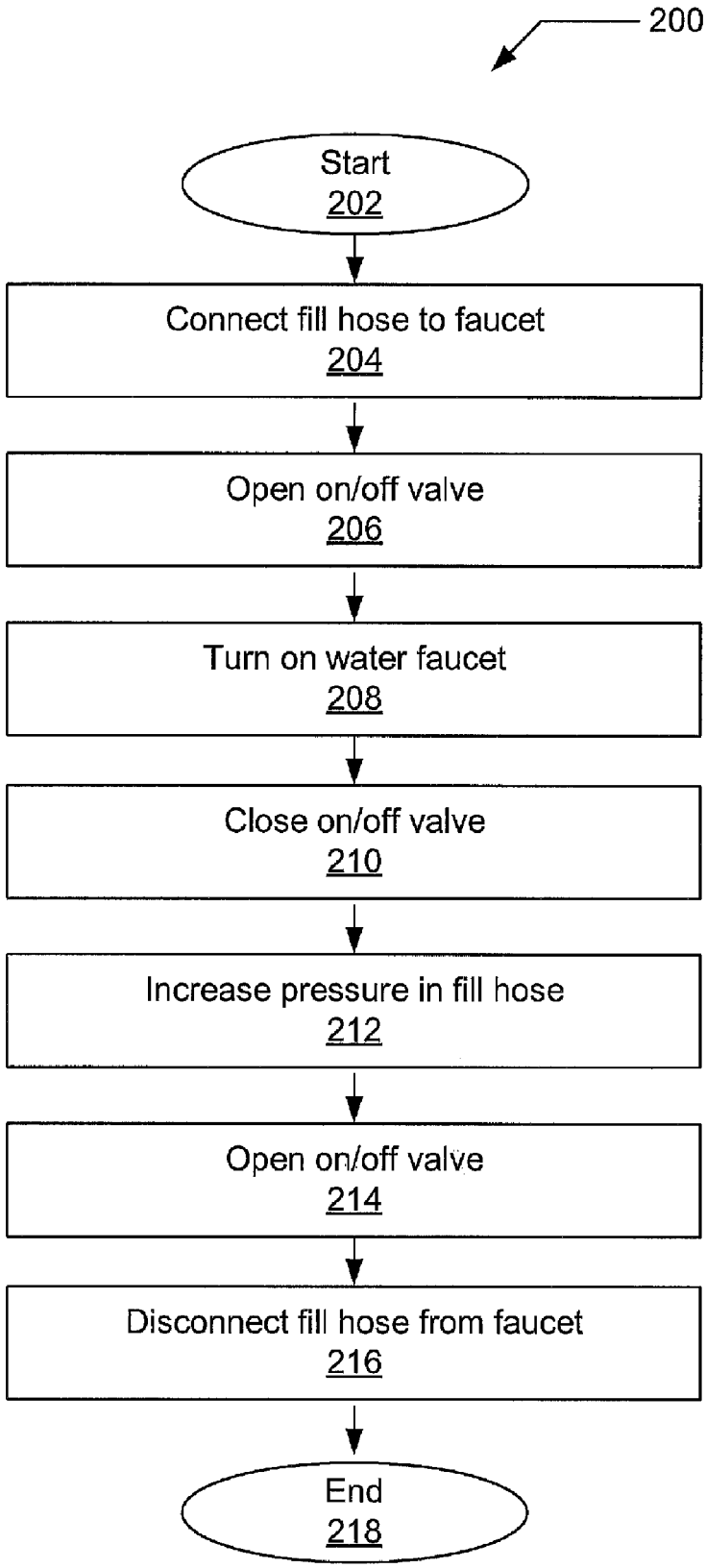
FIG. 2 is a flow diagram of the procedure for use of the reverse flow back pressure pump to remove sediment from water pipes.

In FIG. 2, a flow diagram 200 of the procedure for use of the reverse flow back pressure pump to remove sediment from fixtures is shown. The procedure starts 202 with the fill hose being connected to a faucet 204. The on/off valve 106 is in the first position or open position 206. The faucet is then turned on 208 and water is allowed to flow into the fill hose 108 and eventually out of the discharge hose 110. The on/off valve 106 is placed in a second position or closed position 210. The pressure is then increased in the fill hose 108 by pump 102 being pumped 212. The on/off valve 106 is then placed back into the first position or open position 214 allowing sediment to run out of the faucet via discharge hose 110. The fill hose may then be disconnected from the faucet 216 and water is able to freely flow in the pipe and the procedure is finished 218. If needed to further increase flow of water in the pipes, the procedure may be repeated one or more times.

The foregoing description of an implementation has been presented for purposes of illustration and description. It is not exhaustive and does not limit the claimed invention to the precise form disclosed. Modifications and variations are possible in light of the above description or may be acquired from practicing the invention. Note also that the implementation may vary between systems. The claims and their equivalents define the scope of the invention.

What is claimed is:

1. A reverse flow back pressure pump, comprising:

a pump;

a fill hose capable of being coupled to a faucet;

a discharge hose; and a valve that enables the pump to increase the pressure of a liquid in the fill hose when in a first position and discharge the liquid in a second position, where the liquid flows in a single direction while the pressure is increasing due to the pumping action.

2. The reverse flow back pressure pump of claim 1, where the pump is a diaphragm pump.

3. The reverse flow back pressure pump of claim 1, where the valve is ball valve.

4. The reverse flow back pressure pump of claim 1, where the pump is hand operated.

5. The reverse flow back pressure pump of claim 1, further including a pressure gage located between the pump and the fill hose.

6. The reverse flow back pressure pump of claim 1, further including a strainer located at the discharge hose.

7. The reverse flow back pressure pump of claim 1, further including a strainer located between the fill hose and the pump.

8. The reverse flow back pressure pump of claim 1, further comprising a coupling on the fill hose adapted to couple the fill hose to the faucet.

9. A method for reverse flow back pressure pumping, comprising the steps of:

opening a valve that is coupled to a discharge hose that allows a liquid to flow out of a pump, when the liquid flows in from a fixture that is turned on;

closing the valve to prevent the liquid from leaving the pump via the discharge hose;

pumping the pump to increase the pressure in the fill hose and force the liquid into the fixture, where the liquid flows in a single direction while the pressure is increasing while pumping the pump; and opening the valve releasing the liquid from the pump.

10. The method for reverse flow back pressure pumping of claim 9, where the step of closing the valve further includes changing the position of a handle on a ball valve.

11. The method for reverse flow back pressure pumping of claim 9, further including the step of connecting the fill hose to a faucet.

* * * * *